US007840013B2

(12) United States Patent
Dedieu et al.

(10) Patent No.: US 7,840,013 B2
(45) Date of Patent: Nov. 23, 2010

(54) MICROPHONE ARRAY WITH PHYSICAL BEAMFORMING USING OMNIDIRECTIONAL MICROPHONES

(75) Inventors: Stephanie Dedieu, Ontario (CA); Philippe Moquin, Ontario (CA)

(73) Assignee: Mitel Networks Corporation, Ottawa, Ontario (CA)

( * ) Notice: Subject to any disclaimer, the term of this patent is extended or adjusted under 35 U.S.C. 154(b) by 975 days.

(21) Appl. No.: 10/881,468

(22) Filed: Jul. 1, 2004

(65) Prior Publication Data

US 2007/0110257 A1 May 17, 2007

(30) Foreign Application Priority Data

Jul. 1, 2003 (GB) ..... 0315426.7

(51) Int. Cl.
*H04R 3/00* (2006.01)

(52) U.S. Cl. ..... 381/92; 381/337; 381/160; 381/122

(58) Field of Classification Search ..... 381/92, 381/98, 111, 122, 150, 87, 91, 152, 160, 381/351–353, 345, 360, 337; 367/1–8, 87–138
See application file for complete search history.

(56) References Cited

U.S. PATENT DOCUMENTS

| | | | | |
|---|---|---|---|---|
| 3,819,879 | A | 6/1974 | Baechtold | |
| 4,115,659 | A | 9/1978 | Spanel et al. | |
| 4,741,035 | A | 4/1988 | Genuit | |
| 4,741,038 | A * | 4/1988 | Elko et al. | 381/92 |
| 5,524,059 | A * | 6/1996 | Zurcher | 381/92 |
| 5,526,430 | A * | 6/1996 | Ono et al. | 381/26 |
| 5,742,693 | A * | 4/1998 | Elko | 381/92 |
| 5,748,757 | A | 5/1998 | Kubli et al. | |
| 6,041,127 | A * | 3/2000 | Elko | 381/92 |
| 6,148,089 | A | 11/2000 | Akino | |
| 6,205,224 | B1 | 3/2001 | Underbrink | |
| 6,239,348 | B1 | 5/2001 | Metcalf | |
| 6,305,732 | B1 | 10/2001 | Ruhl | |
| 7,068,801 | B1 * | 6/2006 | Stinson et al. | 381/160 |
| 7,123,735 | B2 * | 10/2006 | Ryan et al. | 381/346 |

FOREIGN PATENT DOCUMENTS

| | | |
|---|---|---|
| EP | 1429581 | 6/2004 |
| EP | 1432280 | 6/2004 |
| FR | 2 358 800 | 2/1978 |
| GB | 48330 | 4/1938 |
| GB | 666494 | 2/1952 |
| GB | 2204402 | 11/1988 |
| WO | WO 99/46956 | 9/1999 |

OTHER PUBLICATIONS

Brandstein et al, Microphone Arrays, Springer, 2001.
Morse, Theoretical Acoustics, 1968, pp. 332-343, Princeton University Press, Princeton, New Jersey.
Meyer, Beamforming for a circular microphone array mounted on spherically shaped objects, Jan. 2001, pp. 185-193, J. Acoust. Soc. Am. 109.
Anciant, Modelisation Du Champ Acoustique Incident Au Decollage De la Fusee Ariane, Universite de Technologie de Compienge, Jul. 8, 1996.
EU Search Report, Apr. 8, 2009, Dedieu et al.

* cited by examiner

*Primary Examiner*—Xu Mei
*Assistant Examiner*—Fatimat O Olaniran

(57) ABSTRACT

An array of microphones is provided wherein the microphones are positioned at the ends of cavities within a diffracting structure. The cavity depth, width, and shape are optimised to provide high directivity without grating lobes, at frequencies for which the distance between microphones is greater than half the acoustic wavelength.

6 Claims, 12 Drawing Sheets

Microphone alone

MICROPHONE ARRAY WITH PHYSICAL BEAMFORMING USING OMNIDIRECTIONAL MICROPHONES

FIELD OF THE INVENTION

The present invention relates in general to microphone arrays, and more particularly to a microphone array incorporating an obstacle having specific characteristics to improve the broadband sensor directivity and consequently the directivity of the array.

BACKGROUND OF THE INVENTION

Directional microphones are well known for use in speech systems to minimise the effects of ambient noise and reverberation. It is also known to use multiple microphones when there is more than one talker, where the microphones are either placed near to the source or more centrally as an array. Moreover, systems are also known for selecting which microphone or combination to use in high noise or reverberant environments. In teleconferencing applications, it is known to use arrays of directional microphones associated with an automatic mixer. The limitation of these systems is that they are either characterised by a fairly modest directionality or they are of costly construction.

Microphone arrays are generally designed as free-field devices and in some instances are embedded within a structure. The limitation of prior art microphone arrays is that the inter-microphone spacing is restricted to half of the shortest wavelength (highest frequency) of interest. This means that for an increase in frequency range, the array must be made smaller (thereby losing low frequency directivity) or alternatively a microphones must be added to the array (thereby increasing cost). Another problem with prior art microphone arrays is that the beamwidth decreases with increasing frequency and sidelobes become more problematic. This results in significant off axis "coloration" of the signals. As it is impossible to predict when a talker will speak, there is necessarily a period time during which the talker will be off axis with consequential "coloration" degraded performance.

The following references illustrate the known state of the art:

[1] Michael Brandstein, Darren. Ward, "Microphone arrays", Springer, 2001.

[2] Gary Elko, "*A steerable and variable first-order differential microphone array*", U.S. Pat. No. 6,041,127, Mar. 21, 2000.

[3] Michael Stinson, James Ryan, "*Microphone array diffracting structure*", Canadian Patent Application 2,292, 357.

[4] Jens Meyer, "*Beamforming for a circular microphone array mounted on spherically shaped objects*", Journal of the Acoustical Society of America 109 (1), January 2001, pp. 185-193.

[5] Marc Anciant, "*Modélisation du champ acoustique incident au décollage de la fusée Ariane*", July 1996, Ph.D. Thesis, Université de Technologie de Compiègne, France.

(7) S. Dedieu, P. Moquin, "Broadband Constant directivity beamforming for non linear and non axi-symmetric arrays", UK Patent Application No. 0229059.1, published as EP1429581.

(8) S. Dedieu, P.Moquin, "Method for extending the frequency range of a beamformer without spatial aliasing", UK Patent Application No. 0229267.0 published as EP1432280.

[9] Morse and Ingard, "Theoretical Acoustics", Princeton University Press, 1968.

Brandstein and Ward [1] provide a good overview of the state of the art in free-field arrays. Most of the work in arrays has been done in free field, where the size of the array is necessarily governed by the frequency span of interest.

The use of an obstacle in a microphone array is discussed in Elko [2]. Specifically, Elko uses a small sphere with microphone dipoles in order to increase wave-travelling time from one microphone to another and thus achieve better performance in terms of directivity. A sphere is used since it permits analytical expressions of the pressure field generated by the source and diffracted by the obstacle. The computation of the pressure at various points on the sphere allows the computation of each of the microphone signal weights. The spacing limit is given as $2\lambda/\pi$ (approx. $0.64\lambda$) where $\lambda$ is the shortest wavelength of interest.

M. Stinson and J. Ryan [3] extend the principle of microphone arrays embedded in obstacles to more complex shapes using a super-directive approach and a Boundary Element method to compute the pressure field diffracted by the obstacle. Stinson and Ryan have proven that using an obstacle provides correct directivity in the low frequency domain, when generally other authors use microphone arrays of large size.

The benefit of an obstacle for a microphone array in terms of directivity and localisation of the source or multiple sources is also described in the literature by Jens Meyer [4] and by Marc Anciant [5]. Jens Meyer demonstrates the benefit of adding a sphere on a microphone array compared to a free-field array in terms of broadband performance and noise rejection. Anciant describes the "shadow" area for a 3D-microphone array around a mock-up of the Ariane IV rocket in detecting and characterising the engine noise sources at take-off.

With the exception of Elko [2] (who sets the spacing limit at $2\lambda/\pi$), the prior art explicitly or implicitly concedes the requirement for a high frequency performance limit defined by an inter-element spacing of $\lambda/2$ to avoid grating lobes in free-field.

In the state of the art it has been recognised that the directionality of a microphone can be increased by the use of a structure attached to the microphone. In U.S. Pat. No. 4,115, 659, Spanel attaches an exponential re-entrant horn to a microphone in order to reduce the "echo" effect of a hands-free telephone conversation. However, the horn is bulky, can only be aimed in one direction and is therefore not very practical. In U.S. Pat. No. 5,748,757, Kubli and West disclose an image-derived microphone with a collapsible structure. This structure does enhance the directivity but, as with Spanel, only in one direction. Another disadvantage is that the structure extends out from the surface of the device. In U.S. Pat. No. 6,148,089, Akino discloses a first order gradient (i.e. cardioid microphone) mounted in a cavity. The mounting structure allows the cardioid microphone to retain its original directionality. Again this is intended for a portable computer so only one direction is provided. Rühl in U.S. Pat. No. 6,305,732 discloses a directional microphone that is integrated into the dashboard of a car and, as with the prior art discussed above, for only one direction. Moreover, all of the prior art systems discussed above use directional microphones that are more expensive than omni-directional microphones.

In accordance with Applicant's own prior inventions [7 and 8] a microphone array is provided with improved directivity having a reasonably constant beampattern over a frequency range that extends beyond the traditional limitation of the inter-sensor spacing of half a wavelength.

It is an object of the present invention to further improve the method used in [8] by optimising the physical characteristics of the obstacle in which the microphones are embedded. This invention addresses the microphone array restrictions discussed above, as well as those of directional microphones that provide only one direction. The combination of an enclosure with optimised physical characteristics into which simple omnidirectional microphones are embedded, provides a beamformer of superior performance as compared to the known prior art.

SUMMARY OF THE INVENTION

According to the present invention, an array of microphones is provided wherein the microphones are positioned at the ends of cavities within the diffracting structure. The cavity depth, width, and shape are optimised to provide high directivity at frequencies for which the distance between microphones is greater than half the acoustic wavelength, without grating lobes.

More particularly, a plurality of microphones are embedded in a diffracting structure having specific characteristics in terms of shape and dimension to provide improved directivity from medium frequency (~1 kHz) to high frequency (up to 7 kHz). The choice of the diffracting structure size is based on acoustic wavelength linked to the frequency range of interest (e.g. 150-7000 Hz for telecommunication applications). Its shape must not be too flat, in order to provide improved front to back attenuation when a pressure wave impinges on the structure.

The array of the present invention is highly directional yet uses only simple omnidirectional microphones with no signal processing for high frequencies. To provide the desired directionality at lower frequencies, beamforming of the microphones may be performed using well known digital signal processing techniques. In one embodiment, acoustically absorptive materials are used on the object to provide acoustic impedance for increased directivity at high frequencies.

The microphone array of the present invention addresses the two above-described weaknesses in prior art approaches: low frequency directivity with small structures and high frequency difficulties that arise in conventional sensor arrays.

One advantage of the invention is the extension of the working frequency range for an existing narrow-band telephony microphone array to wide-band telephony (up to 7 kHz), without modifying the number of microphones. The invention effectively extends the working frequency range of a microphone array beyond its "limit" frequency, which depends on the inter-microphone distance. The invention operates at frequencies where beamforming is possible with only one or two microphones. Thus, the invention is operable with omnidirectional microphones, resulting in cost reduction and the ability to use inexpensive DSPs.

For medium frequencies (1.5 to 2 kHz), the combination of obstacle size and cavities provides high directivity with only one omnidirectional microphone. Alternatively, a wideband telephony conference unit may be provided where the number of microphones, the size and shape of the unit are optimised so that steering a high frequency beam from one sector to another is possible without digital beamforming, by simply selecting the microphone in the desired direction.

BRIEF DESCRIPTION OF THE DRAWINGS

A detailed description of the preferred embodiment is set forth herein below with reference to the following drawings, in which.

DETAILED DESCRIPTION OF THE PREFERRED EMBODIMENT

To illustrate the principles of the invention a conventional spherical shape of diffracting structure is first discussed for an array of embedded microphones. However, the concepts as applied to the simple sphere may be extended to more complicated shapes, as discussed in greater detail below with reference to FIG. 3 et seq.

Figure 2:
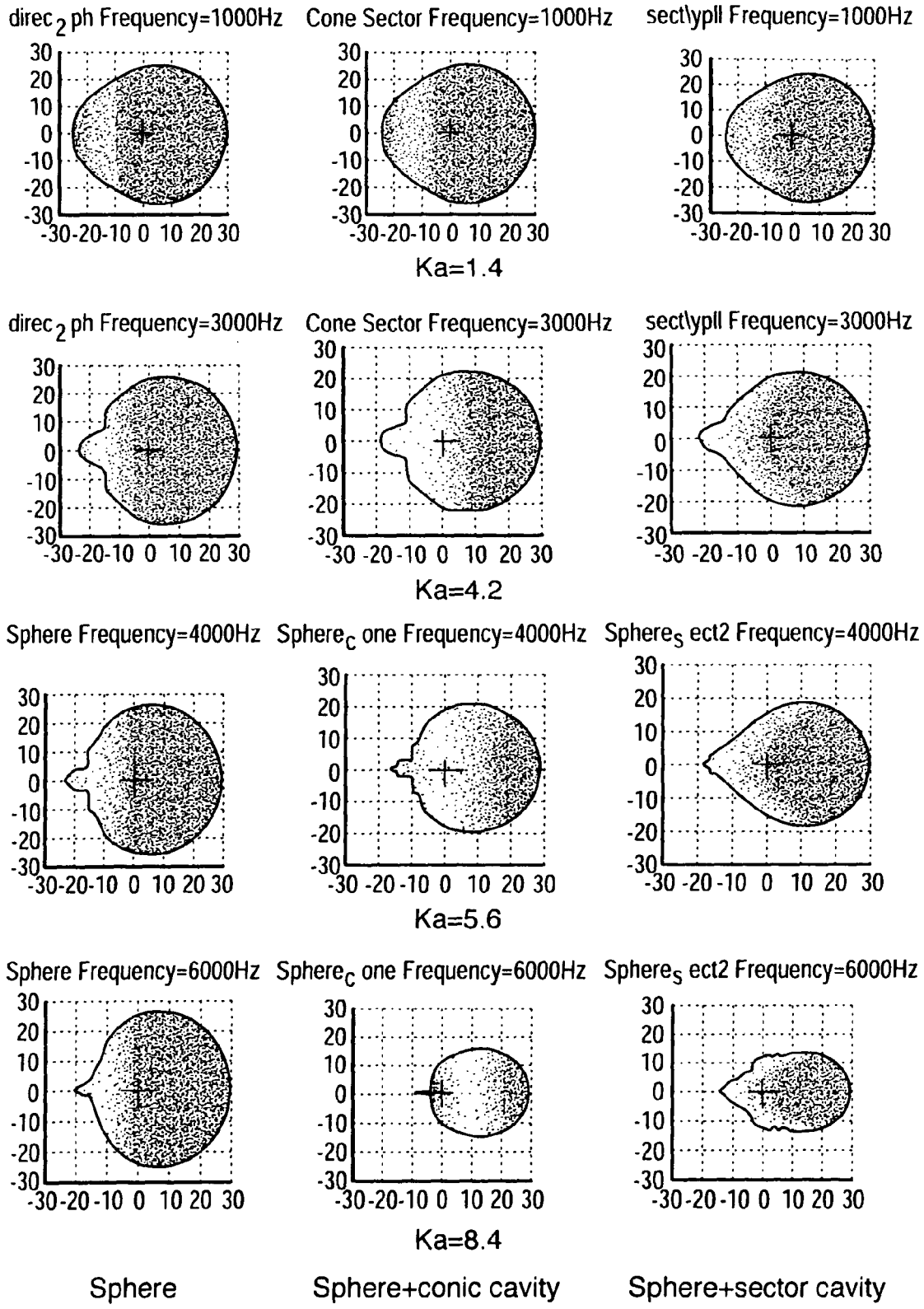
FIG. 2 is a 3-D directivity pattern of a solid sphere, compared to that of the conical and sectoral cavities illustrated in FIG. 1.

An analytical solution to the problem of a hard sphere is provided in Morse [9] (equation 7.2.18). An alternate solution is found in Meyer [4]. Considering the pressure field from a plane wave impinging upon the sphere from various directions, the pressure at a point on the sphere indicates the directionality. Naturally, the solution scales with the size of the object and the frequency. As illustrated in FIG. 2, no significant directionality occurs at frequencies below approximately $ka<2$ where $k=2\pi f/c$ (f=frequency, c=speed of sound) and a is the radius of the sphere.

At lower frequencies (up to D=λ/2 where D is the inter-element spacing) multiple microphones may be disposed on the sphere as suggested by Meyer [4] or Elko [2], thereby extending Meyer's 0.2 m diameter spherical array to cover up to 20 kHz.

Figure 1A:
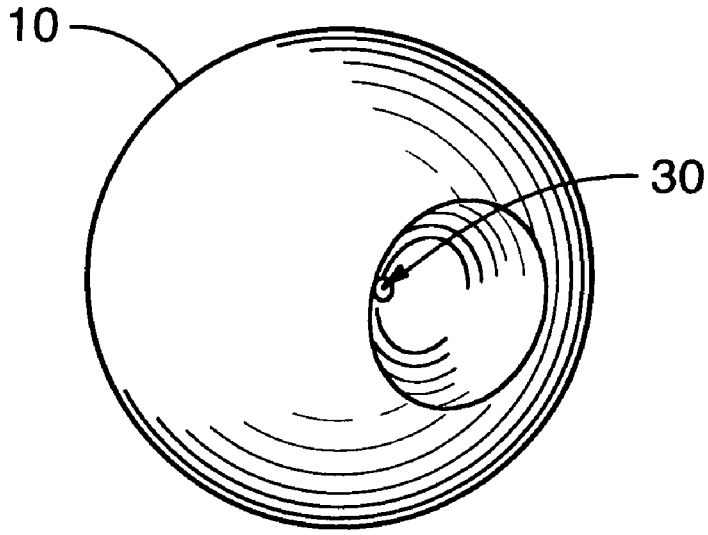
FIG. 1 shows a sphere with conical cavity (FIG. 1A) and sectoral cavity (FIG. 1B)
Figure 1B:
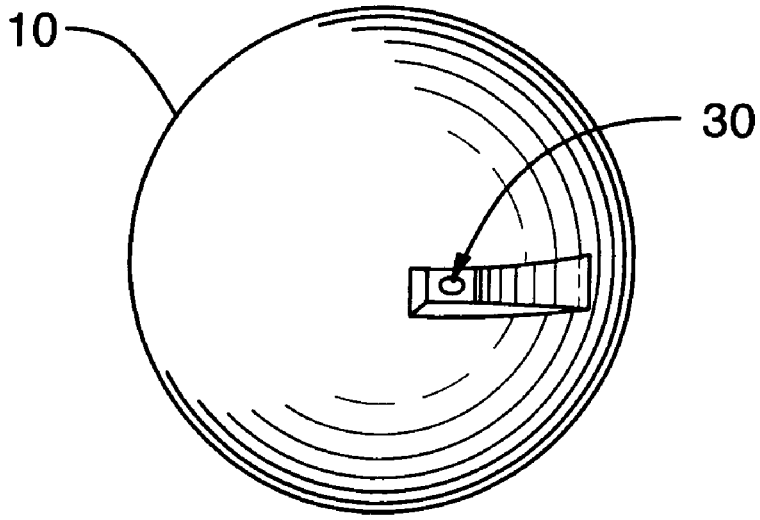

FIG. 1 illustrates a spherical diffracting structure 10 with microphones 30 embedded in cavities whose dimensions and shapes are optimised to tailor the directivity pattern. FIG. 1A shows a circular conical cavity, while FIG. 1B shows a sectoral cavity. The truncated cone shape of FIG. 1A is designed to increase the directivity in both horizontal and vertical planes, whereas the sectoral cavity of FIG. 1B provides higher directivity in the horizontal plane. The cavity shape can be tailored and optimised to give the best compromise in term of vertical and horizontal directivity.

Directivity is achieved in the structures of FIGS. 1A and 1B due to a combination of obstacle size and cavity design. A person of ordinary skill in the art will appreciate that there are a large variety of cavities that can be designed, the specific performances of which can only be predicted using numerical methods. However, the two shapes of FIG. 1 illustrate the range of directionality that is possible according to the present invention.

FIG. 2 provides a comparison of the three-dimensional directivity pattern at 1 meter in three cases: microphone on a rigid sphere (as contemplated by Morse [9]); a microphone at the bottom of a conical cavity in the rigid sphere (FIG. 1A); and a microphone at the bottom of a sectoral cavity in the rigid sphere (FIG. 1B). The effect of the sectoral cavity in the horizontal plane is very evident but in the vertical plane it is not as effective as the conical cavity.

Figure 3A:
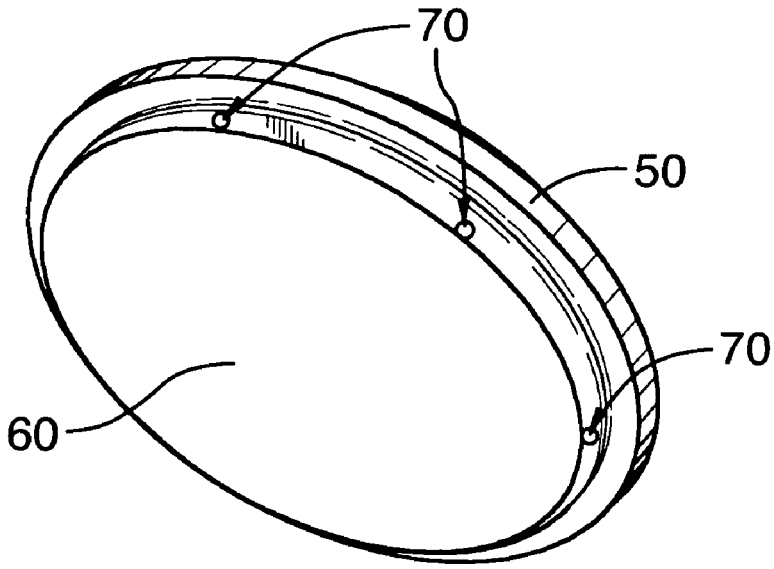
FIG. 3 is a perspective view of the base of a microphone array according to Applicant's own prior art with a conventional smooth design (FIG. 3A) and with V shaped cavities in accordance to the preferred embodiment (FIG. 3B)
Figure 3B:
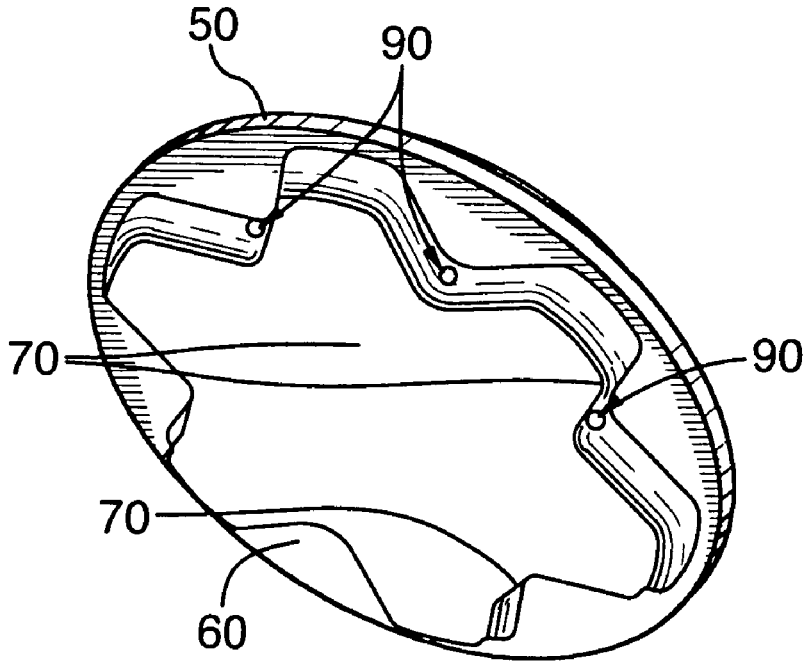

Turning to FIG. 3, an enclosure 50 is provided that acts as a diffracting object to provide the desired high frequency response for the microphones 70. In order to reduce costs and simplify the design, rigid omnidirectional electret microphones are used to sample the pressure field at the surface of the diffracting object 50. In the Applicant's prior art design (FIG. 3A), the pedestal or stand 60 of the enclosure 50 is circular with microphones 70 arranged on the perimeter of the stand. According to the present invention, as shown in FIG. 3B,the stand is generally of "sprocket" shape, with the microphones 70 mounted at the ends of cavities 90. The microphones 70 are combined into an array to achieve the required low frequency response. As discussed in [8], a transition area is established where the system reverts from microphone array operation to selecting a single microphone.

Figure 4:
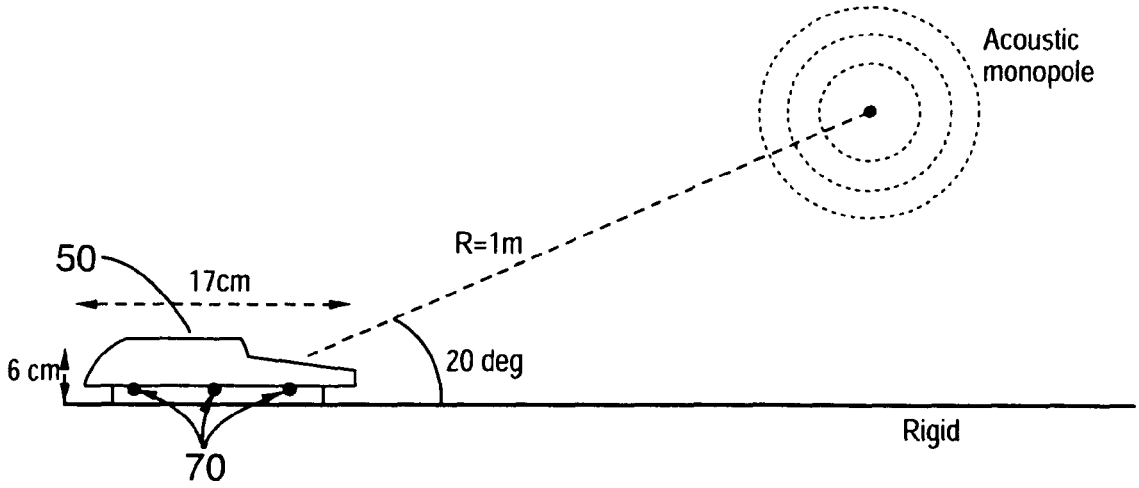
FIG. 4 is schematic side view of a microphone array according to the preferred embodiment and the location of an acoustic source.
Figure 5:
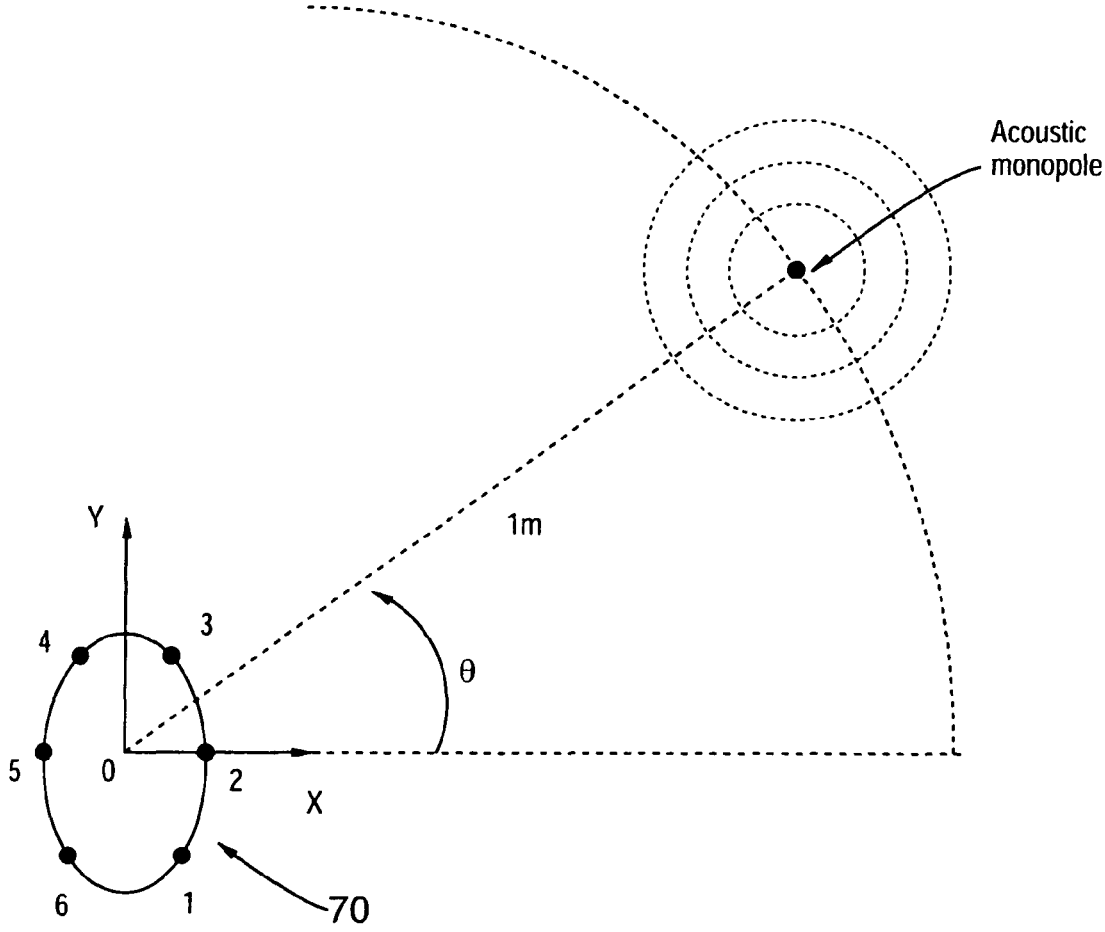
FIG. 5 is a top view of the microphone array and acoustic source of FIG. 4.

The size of the obstacle 50 is constrained by industrial design considerations. The number of microphones 70 is optimised to six so that the distance between microphones is about 80 mm., thereby providing alias-free spatial sampling in the frequency band (i.e. 300-2125 Hz). The obstacle allows beamforming up to 3.4 kHz (in under sampled conditions) as explained in [8]. FIGS. 4 and 5 illustrate the spatial co-ordinates used (spherical co-ordinates where θ is the x-y plane and ψ is the angle between the z direction and the x-y plane). In order to simplify the acoustical modelling, the source of interest is indicated as being an acoustical monopole.

Figure 6:
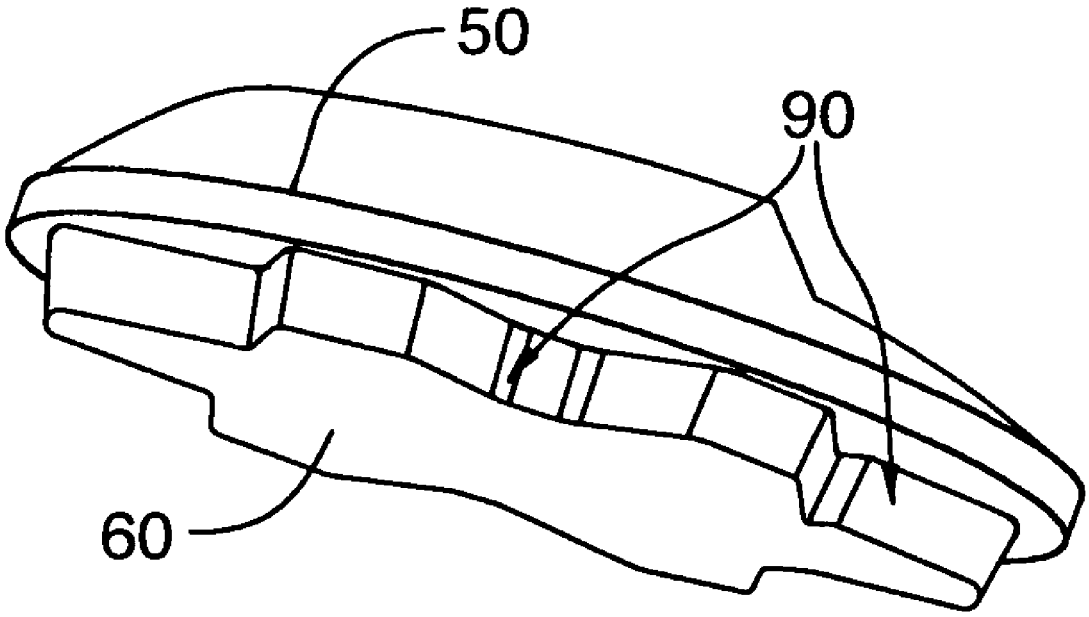
FIG. 6 a Boundary element model of the microphone array according to the preferred embodiment.

Assuming a perfectly rigid obstacle 50, the Boundary Element Method may be used to create the model of FIG. 6, which accounts for a rigid plane and impedance conditions on the surface when an absorbing material is used, as discussed in [8]. The typical source is an acoustic monopole at R=1 m, θ=variable, ψ=20 deg) with an amplitude of 1 N/m2. Solution of the problem using the Boundary Element Method gives the total pressure field on the obstacle as the sum of the incident and diffracted fields.

Applicant's own prior application [8] teaches that an obstacle is able to provide superior directivity compared to a free-field antenna. The provision of cavities 90 in the obstacle 50 of the present invention provides increased directivity compared to an obstacle without cavities.

Figure 7:
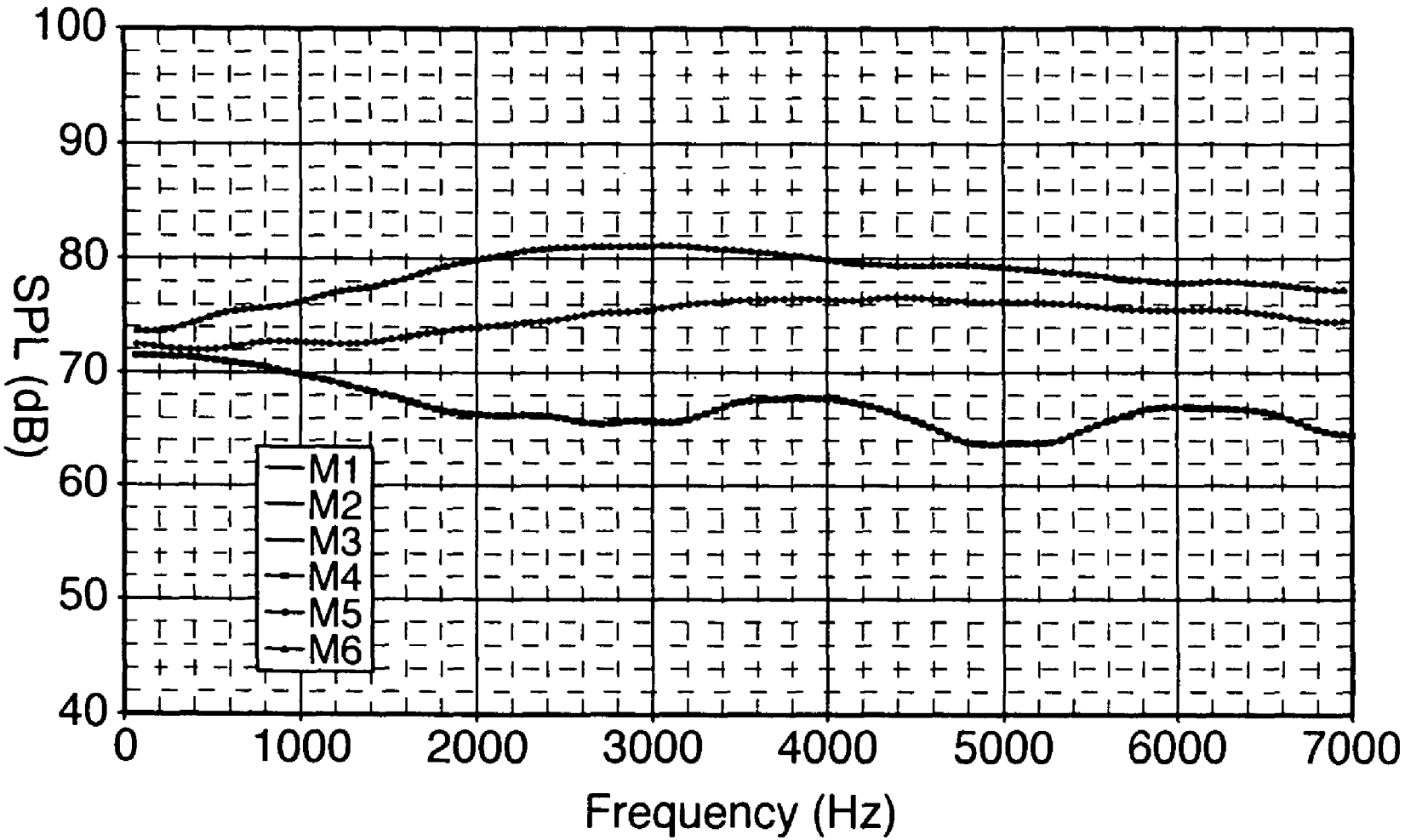
FIG. 7 is the frequency response the microphones according to the conventional smooth stand of FIG. 3A.
Figure 8:
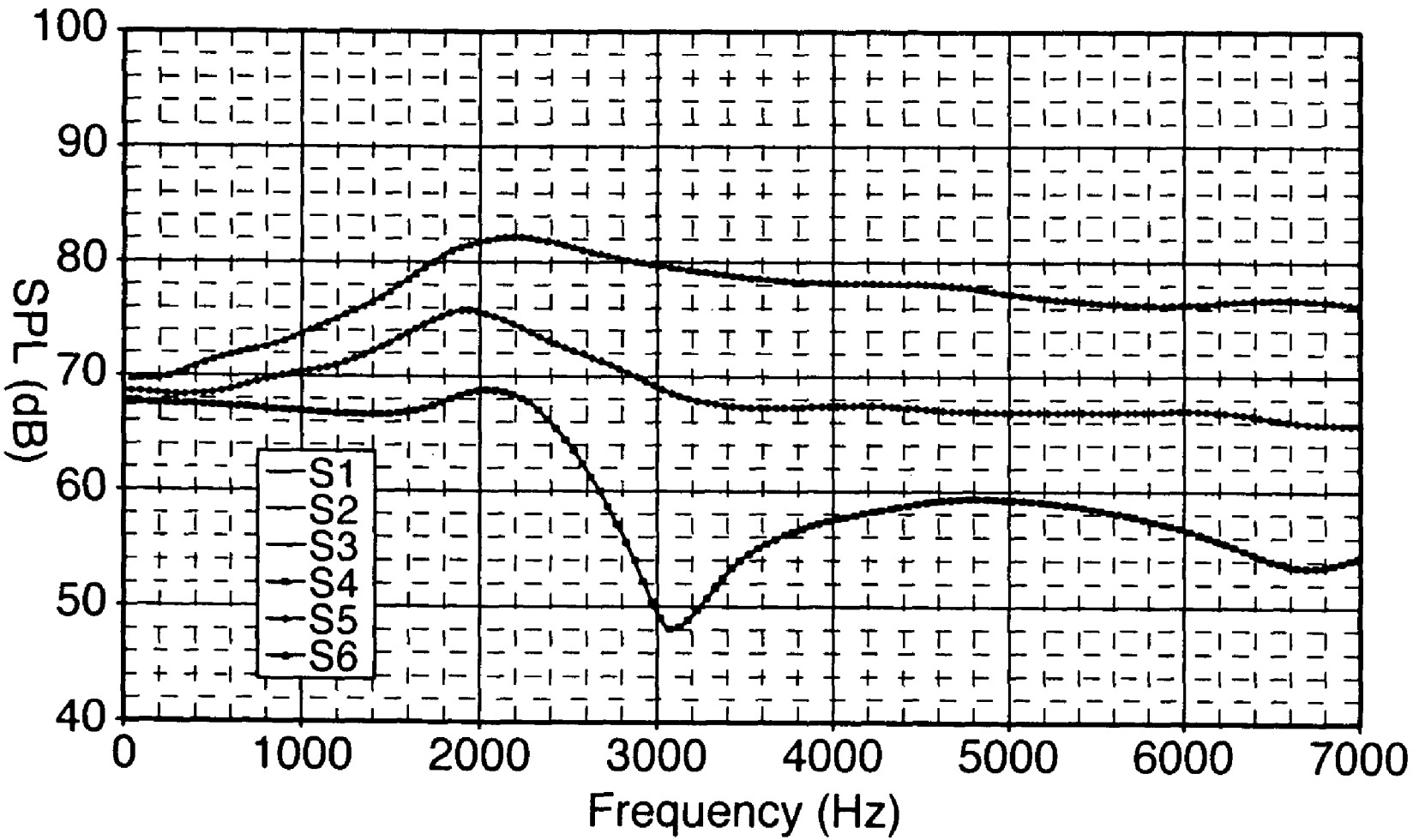
FIG. 8 is the frequency response the microphones according to the preferred embodiment.

FIGS. 7 and 8 show the amplitude computed at respective microphone positions due to a source at (ρ,θ,ψ)=(1 m,−90 deg, 20 deg), for the elliptic stand of FIG. 3A, and the inventive stand with cavities 90 (FIG. 3B), wherein the increased "shadow" effect induces an increase in directivity from 2 kHz. The effect of the cavities 90, however, can be to induce a detrimental resonance if the amplitude is too high. In the present case, the resonance is well controlled and provides about a 2 dB rise at 2000 Hz.

According to a successful prototype of the invention, a small obstacle of about 15 cm diameter and 8 cm height provides a significant shadow effect. This results in an increase of the attenuation starting close to 400 Hz and reaching a maximum of 10 dB at about 2.5 kHz for microphones in the source opposite direction (microphones 3,4,5 in FIGS. 3 and 6). It will also be noted that due to symmetry, the curves for microphones 5 and 6 overlap the curves for microphones 3 and 4, respectively.

Figure 9:
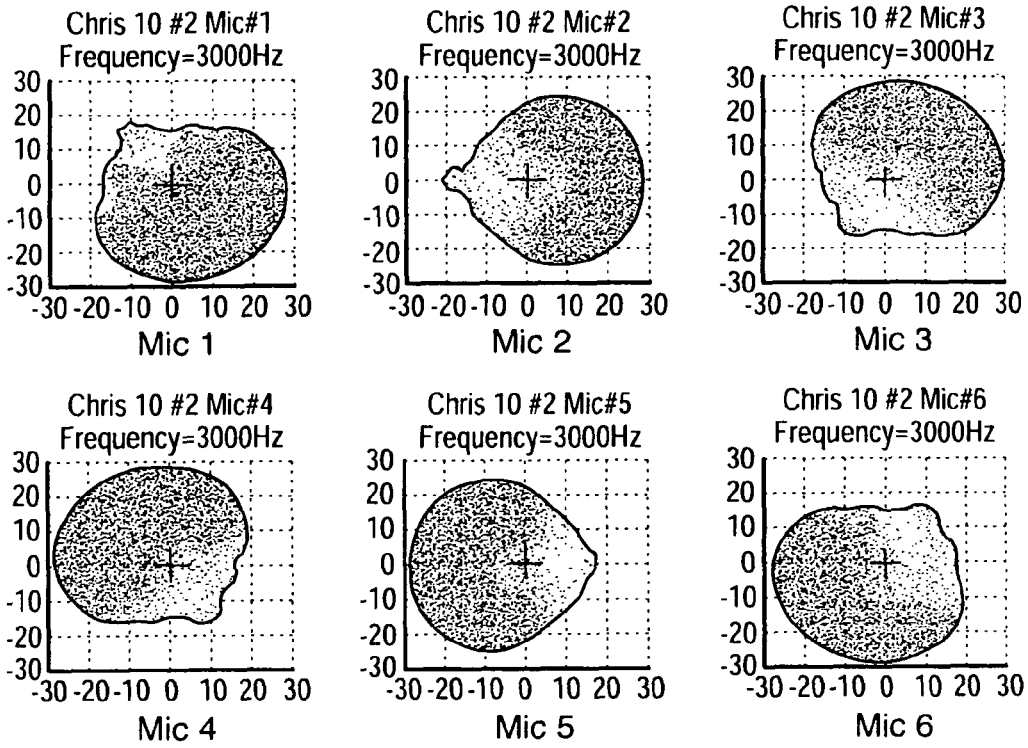
FIG. 9 is the microphone directivity for the smooth stand of FIG. 3A at 3 kHz.
Figure 10:
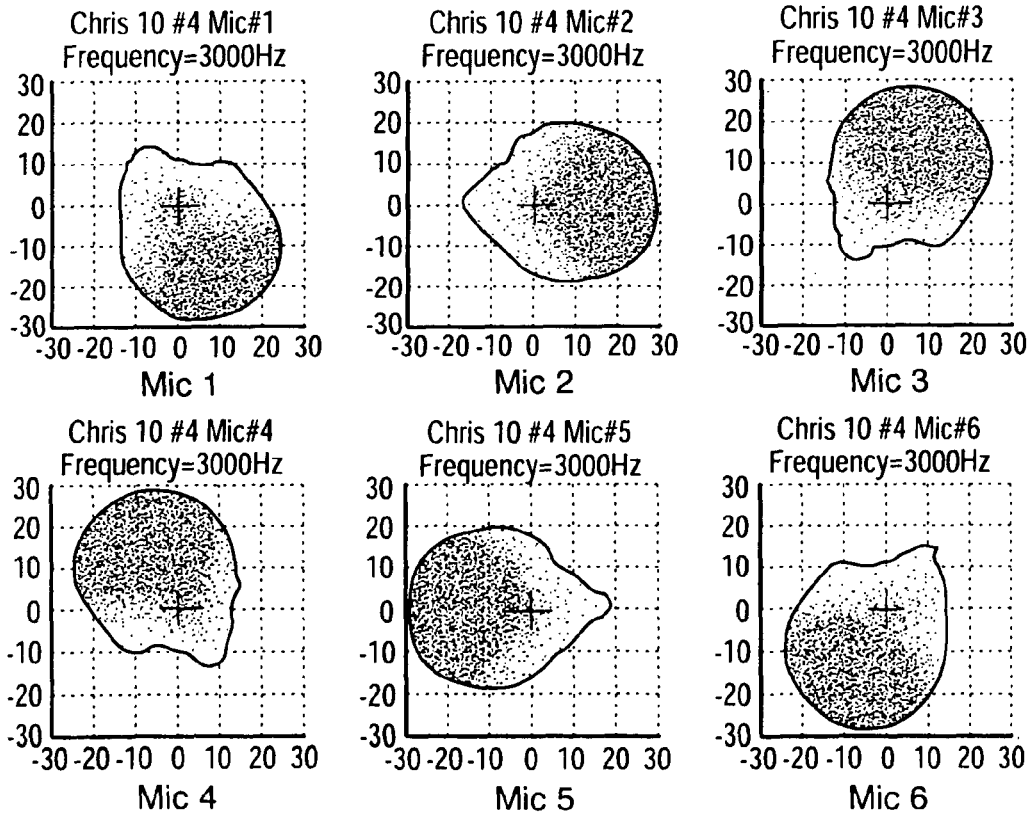
FIG. 10 is the microphone directivity for the microphone array according to the preferred embodiment at 3 kHz.
Figure 11:
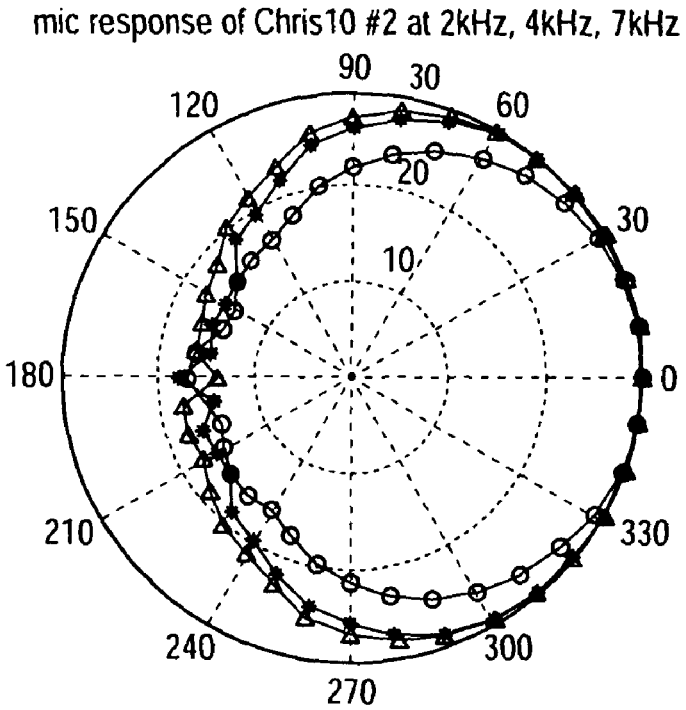
FIG. 11 is the directivity at an elevation of interest for microphone #2 with the smooth stand FIG. 3A.
Figure 12:
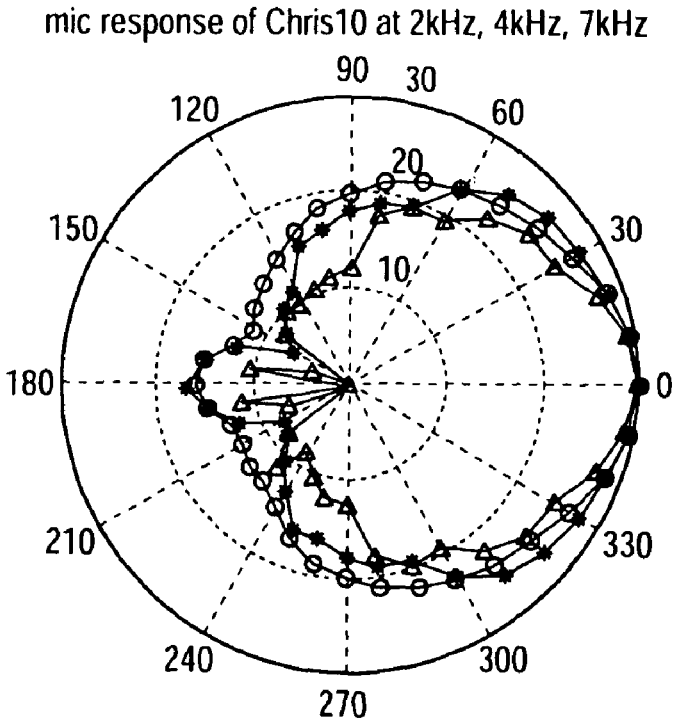
FIG. 12 is the directivity at the elevation of interest for microphone #2 according to the preferred embodiment.

All of the possible sources can be computed at reasonably spaced (e.g. 10 degrees in the illustrated embodiment) intervals for θ and ψ. As a result of the reflecting plane, only the angles from 0 to 90 degrees are required for ψ. Using this data, the beam pattern may be obtained for a microphone 70 in the object 50. The significant impact of the cavities 90 on the directivity of the microphones 70 is shown in FIG. 9 (elliptical stand of FIG. 3A) and FIG. 10 (elliptical stand with cavities of FIG. 3B), where the increase in beamforming directivity is evident. FIGS. 11 and 12 show the directivity of microphone 2 at 2 kHz, 4 kHz, 7 kHz, for the unit with elliptical stand and the elliptical stand with cavities, respectively.

According to the preferred embodiment of FIG. 3B, the microphones 70 are placed at the bottom of cavities 90 around the stand 60. The cavities 90 are shown having a V shape but can be tailored and sized to optimise any desired directivity pattern. For example, as discussed above in connection with FIG. 1A, a cavity with any truncated conical shape will provide increased directivity. In the preferred embodiment, the cavity shape and size optimisation was performed to allow increased directivity upwardly from 2 kHz.

Figure 15:
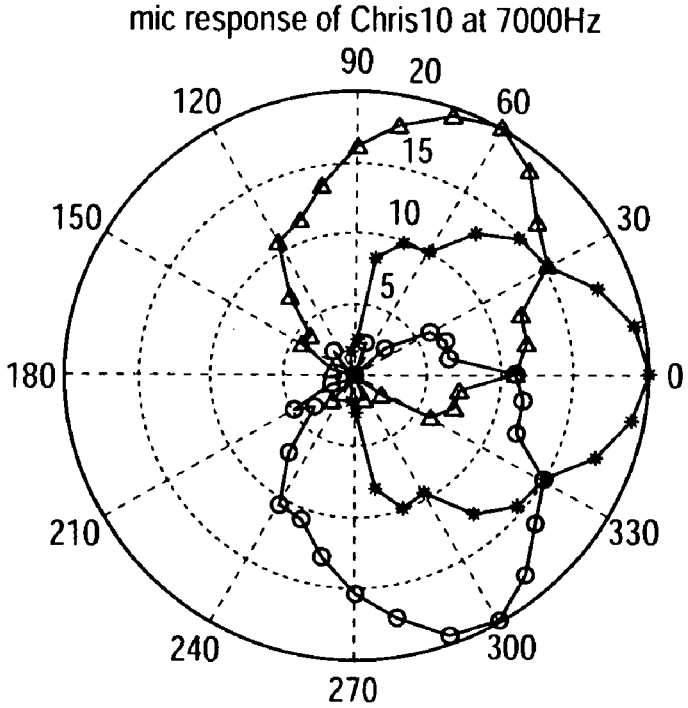
FIG. 15 illustrates the microphone signal coverage for the array according to the present invention at 4 kHz and 7 kHz.
Figure 15:
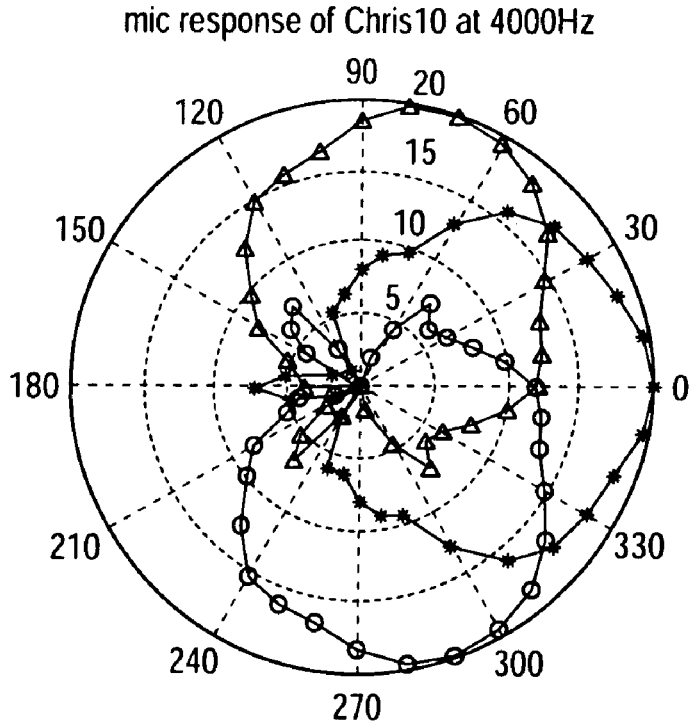

A conference unit in this case switches microphones from one sector to another for the higher frequencies using a sub-banding scheme employing an appropriate filter to split the bands. The high frequency band is the signal corresponding to the microphone signal from the desired direction. For the lower band(s) a beamformer is implemented using some or all of the other microphone signals. A person of skill in the art will appreciate that the foregoing results in a significant reduction in computational burden as compared to full band processing. The high frequency coverage over the plane of interest is reasonably uniform with only six sectors, as illustrated in FIG. 15, for look directions: −60, 0, 60 degrees at 4 and 7 kHz, with directivity at 1 meter in the horizontal plane of the acoustic source.

Figure 13:
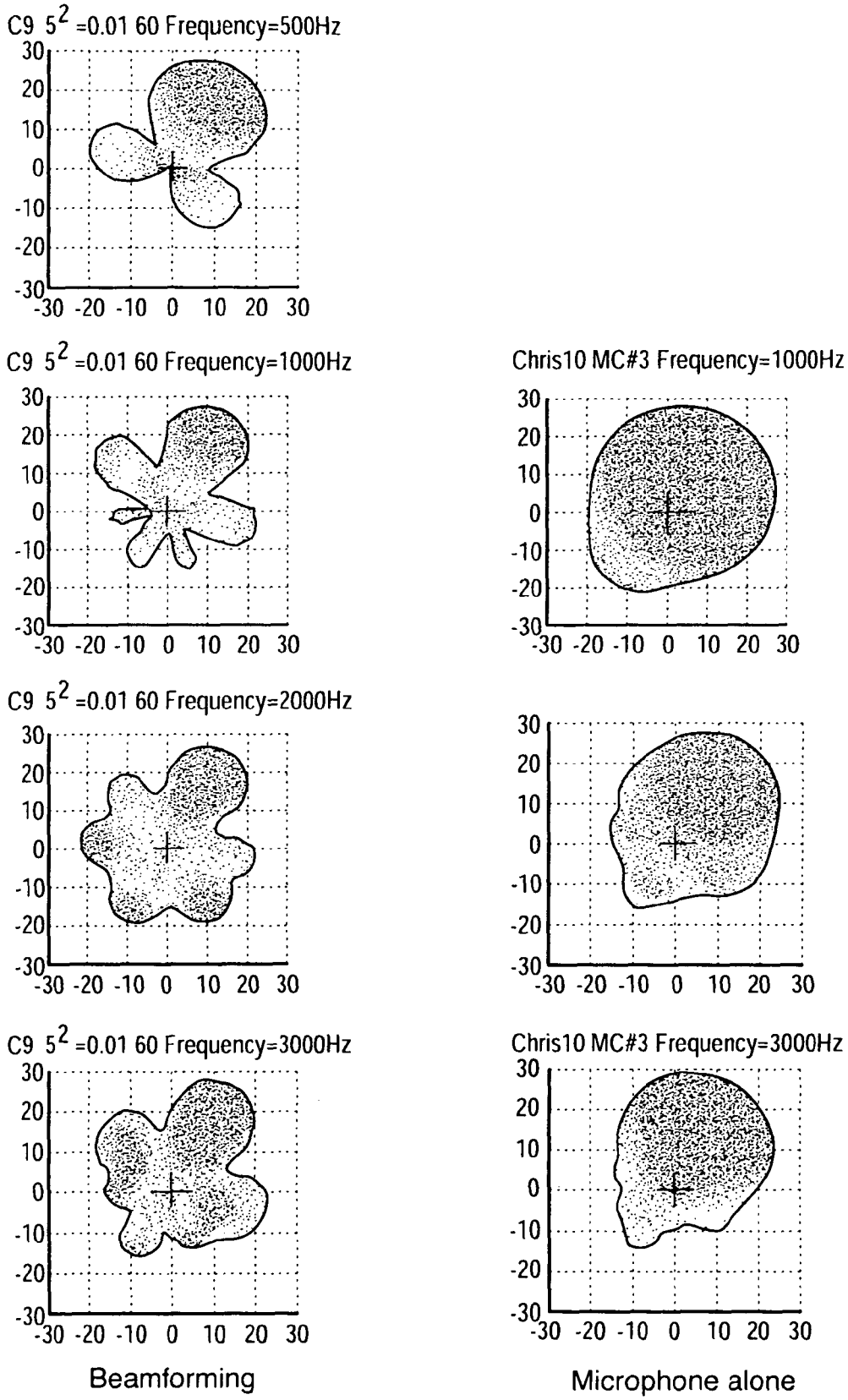
FIG. 13 is the directivity pattern for the microphone array of the preferred embodiment with and without beamforming for 500-3400 Hz.
Figure 14:
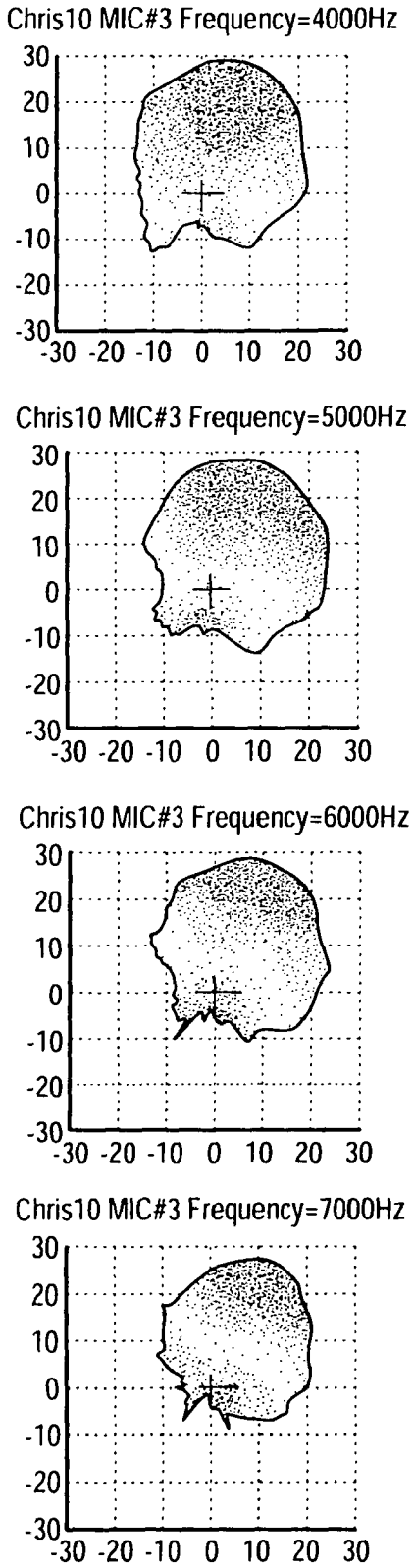
FIG. 14 is the directivity pattern for the microphone array of the preferred embodiment without beamforming for 4000-7000 Hz.

As shown in FIGS. 13 and 14 an improvement in beamforming and microphone switching is shown over conventional beamforming on a smooth object, with and without beamforming for 500-3400 Hz (FIG. 13) and without beamforming for 4000-7000 Hz (FIG. 14). The combination of the obstacle and the cavities results in an improved directivity from 1 kHz and a strong directivity from 2.5 to 7 kHz whereas the distance inter-microphone is over 70 mm, (i.e the limit frequency is close to 2.4 kHz). Beamforming using a super-directive approach can be performed up to 3.4 kHz in these conditions, which is far above the limit frequency for a free field array (i.e. under 2400 Hz).

According to another aspect of the invention, a layer of acoustic absorbent material (such as open cell foam or felt) is applied in a thin layer to the surface of the obstacle 50 to absorb sound at high frequencies. This, along with the cavity shape enhances the directivity of the microphone system.

Furthermore, grating lobes in the beams may be corrected and the transition made less abrupt, by using linear constraints, as set forth in [7].

A person skilled in the art may conceive of variations or modifications of the invention. For example, a person skilled in the art will recognise that the principles embodied herein can be applied to wave sensors that are not microphones (e.g. radio-frequency antennae, hydrophones, etc.). In such applications, the diffracting structure 50 must be shaped and sized to operate at the frequencies of interest to permit a spacing larger than $\lambda/2$ as the grating lobes are attenuated by the diffracting structure. All such variations and modifications are believed to be within the sphere and scope of the present invention as defined by the claims appended hereto.

We claim:

1. A sensor array for use in a beamformer, comprising: a diffracting structure having a radius (a) greater than 2/k in at least one plane of interest, where k is $2\pi f/c$, $\lambda=c/f$ and c is the speed of sound, $\lambda$ is the wavelength of sound and f is the lowest frequency of interest;

at least two cavities in the perimeter of said diffracting structure; and at least two sensors disposed at the ends of respective ones of said cavities and spaced apart by more than $\lambda/2$, wherein said beamformer reverts to a single one of said sensors above a predetermined frequency (f) that is greater than the lowest frequency of interest.

2. The sensor array of claim 1, wherein said cavities are shaped as truncated cones.

3. The sensor array of claim 1, wherein said cavities are sectoral shaped.

4. The sensor array of claim 1, wherein said cavities are V shaped.

5. The sensor array of claim 1, wherein said sensors are omnidirectional microphones.

6. The sensor array of claim 1, further including acoustically absorptive materials applied to the surface of said diffracting object to provide acoustic impedance for increased directivity above said predetermined frequency.

* * * * *